US005791572A

United States Patent [19]

Fernlund

[11] Patent Number: 5,791,572

[45] Date of Patent: Aug. 11, 1998

[54] DISINTEGRATION DEVICE

[75] Inventor: Stefan Fernlund, Njutåanger, Sweden

[73] Assignee: Svedala-Arbra AB, Arbra, Sweden

[21] Appl. No.: 737,646

[22] PCT Filed: May 4, 1995

[86] PCT No.: PCT/SE95/00487

§ 371 Date: Nov. 5, 1996

§ 102(e) Date: Nov. 5, 1996

[87] PCT Pub. No.: WO95/30485

PCT Pub. Date: Nov. 16, 1995

[30] Foreign Application Priority Data

May 6, 1994 [SE] Sweden ..... 9401595

[51] Int. Cl.[6] ..... B02C 19/22

[52] U.S. Cl. ..... 241/260.1; 241/261

[58] Field of Search ..... 241/260.1, 261; 366/266, 297, 81, 83, 97, 247, 300, 301, 323

[56] References Cited

U.S. PATENT DOCUMENTS

| | | | |
|---|---|---|---|
| 2,717,742 | 9/1955 | Weigham et al. | 241/260.1 |
| 5,622,323 | 4/1997 | Krueger et al. | 241/260.1 |

FOREIGN PATENT DOCUMENTS

| | | | |
|---|---|---|---|
| 1262173 | 3/1968 | Germany | 241/260.1 |
| 2702653 | 7/1978 | Germany | 241/260.1 |
| 3704713 | 7/1988 | Germany | 241/260.1 |
| 406114284 | 4/1994 | Japan | 241/260.1 |
| 401 987 | 6/1978 | Sweden . | |
| 8103696-4 | 4/1983 | Sweden . | |
| 443 728 | 3/1986 | Sweden . | |
| 1431837 | 10/1988 | U.S.S.R. | 241/260.1 |
| 2054406 | 2/1981 | United Kingdom | 241/260.1 |

*Primary Examiner*—Mark Rosenbaum
*Attorney, Agent, or Firm*—Zarley, McKee, Thomte, Voorhees, & Sease

[57] ABSTRACT

A device for disintegration of material comprises at least one first axle (2) having first processing members (5) arranged to actuate material, on rotation of the axle, in an axial direction towards second processing members (7) for disintegration of the material. In addition, the axle is provided with members (10) arranged to actuate and tend to convey, on rotation of the axle, material transversely to the axle.

21 Claims, 4 Drawing Sheets

DISINTEGRATION DEVICE

FIELD OF THE INVENTION AND PRIOR ART

The present invention is related to a device for disintegration of material according to the preamble of the appendent claim 1.

Such devices may be adapted for disintegration of, generally speaking, any material but hereinafter the particular case of disintegration of coarse material will be discussed for the purpose of illustrating the invention but in no way restrict the same. Such coarse material may for instance consist of tree stumps, peat, particle boards, bricks, industrial waste, cardboard and asphalt, which one desires to disintegrate mainly for recovery purposes, but also for producing, for example, fuel.

A device of this nature is previously known by the Swedish patent 8103696-4. The device described in this patent comprises axles placed beside each other, said axles being provided with first and second processing members in the form of a screw thread helically extending on the respective axle. The axles are caused to rotate in such directions, that a first axle, by means of its processing members, engages and seeks to displace material to be disintegrated in an axial direction relative to the processing members provided on the second axle, the latter processing members seeking to actuate, accordingly, the material in an opposite direction relative to the processing members arranged on the first axle. This means in practice that a first of the axles is rotated such that its processing members actuate the material in one axial direction and the second axle is rotated so that its processing members actuate the material in an opposite direction, although it theoretically would also be possible to rotate the axles so that the processing members of the different axles actuate the material in the same direction but with different speeds. This type of disintegration by means of axial actuation of the material in opposite directions and the combination of shearing, pressing, tearing and breaking movements obtained thereby involves in many cases a far more efficient disintegration of the material than by means of various previously known devices for disintegration by hammering or slitting of the material.

Thus, this device is basically very efficient for disintegration of most types of material, but it may experience difficulties to get hold of material having certain geometrical shapes for disintegration thereof by means of its processing members. This is primarily due for elongated material having relatively smooth surfaces, such as for example logs or rods tending to lie down on top of the adjacent processing members and slide or rotate thereon during rotation of the axles without entering into the real disintegration area between the first and second processing members. In order to initiate a disintegration of for instance a log it is often required that the log comprises a lug or similar projection, which can be engaged by some of the processing members so as to move the log into fractionation between the first and the second processing members.

SUMMARY OF THE INVENTION

The object of the present invention is to provide a device capable of disintegrating material in an even more efficient manner than previously known devices of the nature mentioned by way of introduction, said device reducing or eliminating the above inconvenience of disintegration of material with certain shapes.

This object is achieved according to the invention by providing a device according to the enclosed claim 1.

Thanks to the provision of members actuating the material transversely to the axle, the material will be susceptible of being conveyed into the processing zone for axial actuation of the material between the first and second processing members for the wanted efficient disintegration in the preferable manner described hereinabove. In this way the material, which the processing members previously had difficulties in engaging, will be efficiently moved, on rotation of the axle, into a position, in which disintegration between the first and second processing members may start.

According to a preferred embodiment of the invention, each of said conveying members is arranged with an interspace to an adjacent first processing member at least in one direction of the axle. In this way the conveying members will not interfere with and influence, to an unnecessary extent, the preferable disintegration function of the device provided by the first and second processing members.

According to a further preferred embodiment of the invention, at least one of the first processing members is arranged to extend about the axle and project from the mantle thereof, said processing member comprising, along at least a part of its extent, a recess designed to decrease the amount of projection of the processing member from the mantle of the axle as compared to the extent of the processing member for the rest, at least one conveying member being provided on the axle in the vicinity of that processing member, which is provided with the recess, within the circumferential extent of the recess, as viewed in axial direction, said conveying member projecting further than the last mentioned processing member in a radial direction outwardly from the axle within said circumferential extent of the recess. This design of the processing member in combination with the location of the conveying member has the consequence that the conveying member may efficiently engage the material in question and actuate the same transversely to the axle into a suitable disintegration position between the first and second processing members, without the conveying member for that purpose having to project excessively far from the axle and in that way influence the function as regards axial actuation of the processing members, since it is entirely possible to design the conveying members so that they are present inwardly of a circle generated by portions, which are adjacent to the recess, of the first processing member on rotation of the axle.

According to a yet further preferred embodiment, the conveying member is provided with portions designed for actuation of the material in the direction of rotation of the axle, said portions being arranged in the region of the rear end of said recess. This means that substantially the entire extent of the recess may be used for receiving material, which by means of the subsequent conveying member then may be moved into a desired disintegration position.

According to a preferred embodiment of the invention the mantle of the axle is, at least in the region of one end of the axle, free from first processing members, at least one said conveying member is arranged in this region and at least one second processing member is arranged in the vicinity of the axle oppositely, in the transverse direction thereof, to the conveying member to be hit by material conveyed by the latter. In this way it can be avoided that the first processing members actuate material in axial direction outwardly against gables or similar, which hold the axle, of the device and deform the same or introduce material fragments into bearings and similar, but instead material arriving in the end region in question may by means of the conveying members be moved to the second processing members so as to be, according to one embodiment, disintegrated between the conveying member and the second processing member or to be, according to a second embodiment, moved with the second processing members in a direction towards the opposite end of the first axle for disintegration of material between the first and second processing members in such a region of the first axle which presents first processing members.

A device according to a preferred embodiment of the invention according to the alternative last mentioned comprises a second rotatable axle, on which the second processing members are arranged and the two axles are arranged to be rotated while obtaining an actuation of material by means of the first processing members relative to the second and vice versa in opposite axial directions for disintegration of material. At least the second processing member which is arranged opposite to said end region which is free from first processing members is designed to actuate, on rotation of the second axle in a direction intended for material disintegration, material in an axial direction towards the opposite end region of the first axle.

Further advantages with and preferable features of the invention appear from the following description and the rest of the dependent claims.

SHORT DESCRIPTION OF THE DRAWINGS

Preferred embodiments of the invention are described hereunder as examples reference to the enclosed drawings, in which.

Figure 14:
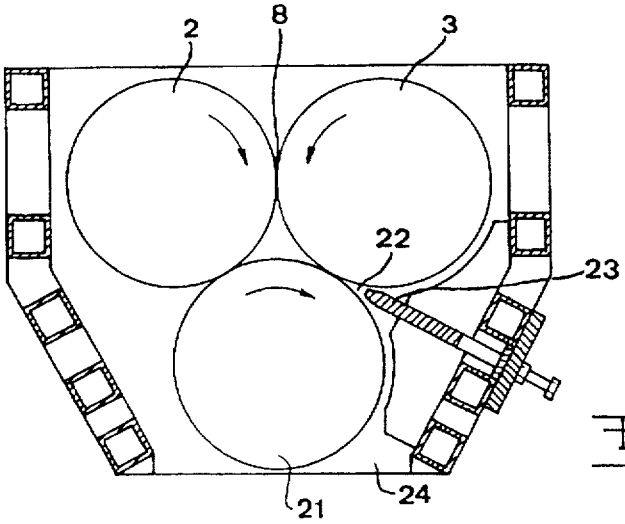

FIG. 14 simplified cross section through a device according to the invention for the purpose of assisting in explaining how disintegration may occur.

DETAILED DESCRIPTION OF PREFERRED EMBODIMENTS OF THE INVENTION

Figure 1:
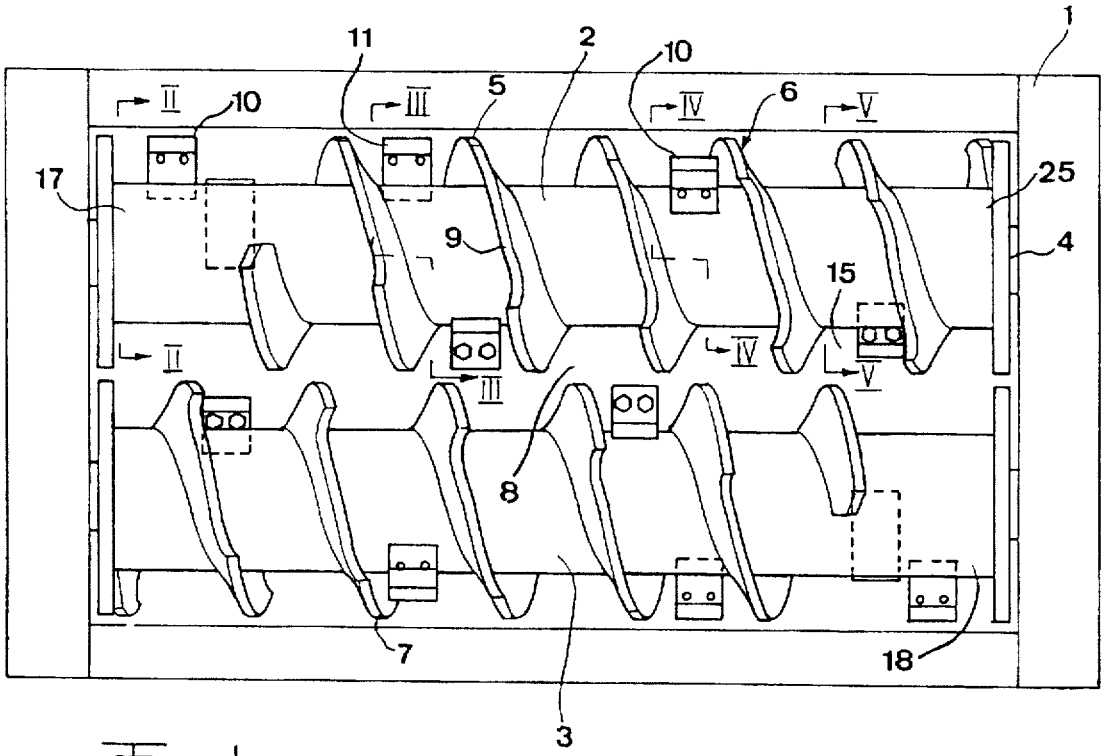
FIG. 1 is a simplified view from above of a device according to a first preferred embodiment of the invention.
Figure 2:
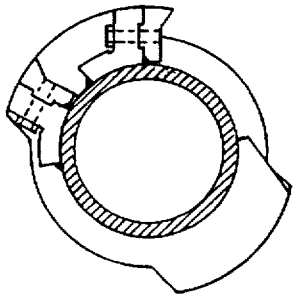
FIGS. 2, 3, 4 and 5 are sectional views along the lines II—II, III—III, IV—IV and V—V respectively in FIG. 1.

In FIG. 1 a device according to the invention is illustrated. Said device comprises a frame 1, relative to which two axles 2, 3 are rotatably supported in diagrammatically indicated bearings 4. The frame 1 may have a funnel like character or some other suitable shape for supplying material, preferably from above, to the area of the axles 2, 3. Driving members not illustrated are also arranged on the frame for driving the axles 2, 3 to rotate.

A first of the axles 2 comprises first processing members 5, which are formed by in axial direction consecutive thread turn portions of a screw thread 6 extending helically about the axle. The screw thread 6 is secured to the mantle of the axle and the thread portions present an aggressiveness to the left as viewed in FIG. 1, said aggressiveness being suitable for engaging material and seeking to actuate it substantially in axial direction to the left as viewed in FIG. 1. For this purpose the axle 2 is, accordingly, intended to be rotated in counter clockwise direction as viewed in axial direction from the right in FIG. 1.

The second axle 3 is provided with second processing members 7, which are designed in the same manner as the first processing members 5, but in such a way that the second axle 3 with its processing members correspond to the first axle with its processing members turned endwise in the amount of 180 degrees, so that a rotation of the second axle 3 counter clockwise as viewed in axial direction from the left in FIG. 1 will cause a substantially axial actuation of material via the second processing members 7 to the right in FIG. 1.

By rotating the two axles 2, 3 in said directions material entering into a processing zone 8 will, accordingly, be actuated substantially axially by the first and second processing members present in said zone in opposite directions and in this way be exposed to a combination of shearing, pressing, tearing and breaking actuation, which tends to achieve, initially, cracks in the material and, then, tear it apart into smaller fragments, which by influence of gravity may fall down between the axles and be transported away in a suitable manner.

Furthermore, the processing members 5, 7 comprise, along a part of their extent about the axle in question, a recess 9, which in the present case corresponds to an angle of about 90 degrees as viewed in axial direction. The shape of the recess 9 as viewed in axial direction appears from FIGS. 2–5 and is designed to decrease the amount of projection of the processing member from the mantle of the axle in relation to the circumferential extent for the rest of the processing member. Each thread turn may comprise two such recesses 9 arranged in a substantially opposite manner. Furthermore, conveying members 10 are arranged on the axles 2, 3, said conveying members having, as an example, the designs illustrated in FIGS. 6 and 8, and being arranged to, on rotation of the axles, contact, actuate and seek to bring with them material substantially tangentially, i.e. transversely to the axles. The conveying members comprise portions 11 designed for material actuation, said portions 11 being directed substantially in the direction of rotation of the axle in question.

The axles are provided with conveying members in the areas between consecutive processing members (thread turns) as well as in an end region of the respective axle, said end region being free from processing members. However, the interspace between certain processing members may optionally be without conveying members.

Figure 3:
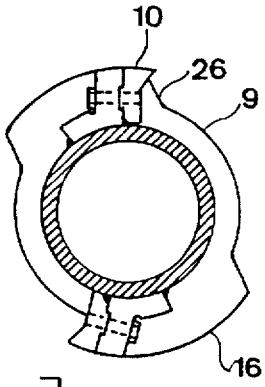
Figure 4:
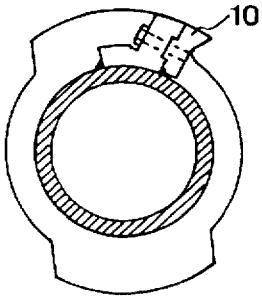
Figure 5:
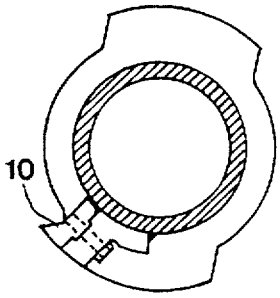
Figure 6:
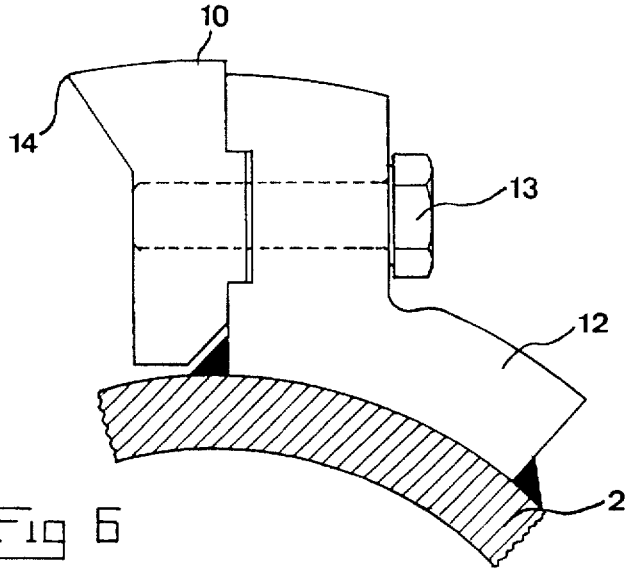
FIG. 6 is an enlarged view in axial direction of a conveying member arranged in the device according to FIG. 1.
Figure 7:
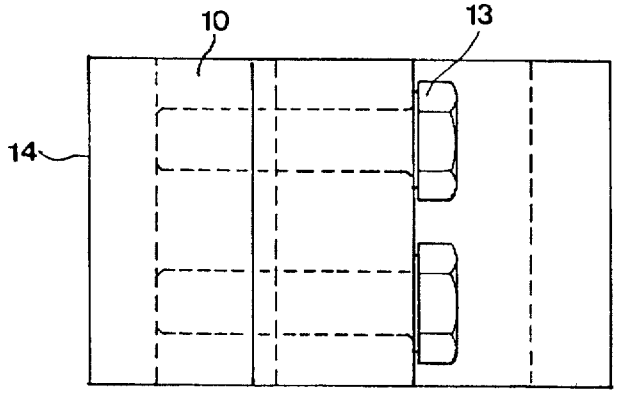
FIG. 7 is a view from above of the conveying members illustrated in FIG. 6.

In FIGS. 3–5 it is illustrated how the conveying members 10 arranged between the processing members are provided on the first axle 2, the device on the axle 3 being designed in a corresponding manner. It is illustrated in FIG. 6 how the conveying member 10 is secured to the axle. The conveying member is removably secured to the axle 2 by means of a holder 12, which is secured to the axle, preferably by welding, so that it, after having been worn out, easily may be replaced by a new one. The conveying member 10 may be secured to the holder 12 by tightening of two bolts 13.

The material actuating portions 11 of the conveying member comprise here a cutting edge 14, which, accordingly, also will actuate the material in a machining manner to some extent.

The conveying members arranged between consecutive processing members are provided with an interspace 15 relative to the two adjacent processing members in axial direction. Furthermore, it appears from FIGS. 3–5 that the conveying members 10 are designed to be within the circle generated by such portions 16 of the processing member in question which are adjacent to the recess 9 on rotation of the axle in question. The conveying members are arranged in the direction of rotation of the respective axle with the portions 11 designed for material actuation in the region of the rear end 26 of the recess 9 in question.

The conveying members 10 arranged between the processing members have the following influence on the function of the disintegration device: primarily elongated elements, such as logs, having substantially smooth surfaces, which have a tendency to lie down above the radially directed surfaces of the processing members and roll or slide thereon without entering into the processing zone 8 between the two axles, will fall down into the recesses 9 of the processing members and be conveyed substantially tangentially towards the processing zone 8 by means of the conveying member arranged at the level of the end of the respective recess, the processing members 5 and 7 being capable of engaging the material in question in said processing zone and breaking the same into pieces by substantially axial actuation thereon. Thus, the conveying members will make certain that material supplied to the device will be efficiently moved into the actual processing zone 8 for disintegration of the material and it is evident that the conveying members will actuate all kinds of material towards the processing zone and not only material of the problematic kind mentioned above.

Processing members 5, 7 do not occur in the most remote, as viewed in the direction of feed, end regions 17, 18 of the two axles 2 and 3 respectively since it would involve unnecessary strains on the respective gable of the frame 1 and adjacent parts of the device to feed material thereagainst, and in addition material could not be disintegrated as efficiently in the areas close to the gables as further into the device, as viewed in an axial direction. In these end regions 17, 18 the conveying members 10 of the kind previously described are, however, arranged on the respective axles to actuate and seek to bring with them material transversely to the respective axle substantially in the direction of rotation of the axle. In this way it is achieved that material arriving to the respective end regions 17, 18 is conveyed by the respective conveying members in a direction towards the opposite axle so as to be able to be engaged by the processing members of that axle and be fed in an axial direction towards the centre of the device so as to enter into the processing zone 8 between the first and the second processing members and be disintegrated thereby. In this way the disintegration of material is concentrated to the regions where there are first as well as second processing members and the disintegration is maintained spaced from the areas close to the gables where material disintegration is not desirable, at least not such disintegration which results in axially directed forces on the gables. On the contrary, the conveying members 10 arranged in a respective end region will achieve a certain material disintegration in this region by conveying and causing material to "hit" substantially in tangential direction against the opposite processing members of the opposite axle. Such material disintegration carried out transversely to the axles in the areas close to the gables of the device is not detrimental but may be an excellent complement to disintegration obtained in other regions of the device by means of axial actuation between the processing members 5 and 7. This disintegration may be made more efficient in case the material actuating portions 11 of the conveying member 10 is designed so as to be material disintegrating, for instance provided with a cutting edge 14 illustrated in FIG. 6. In the present case both conveying members in the end regions are arranged where the distance between the processing members and the axle end or gable in question is the largest and in a mutual angular distance falling below 90 degrees (see FIG. 2).

Figure 8:
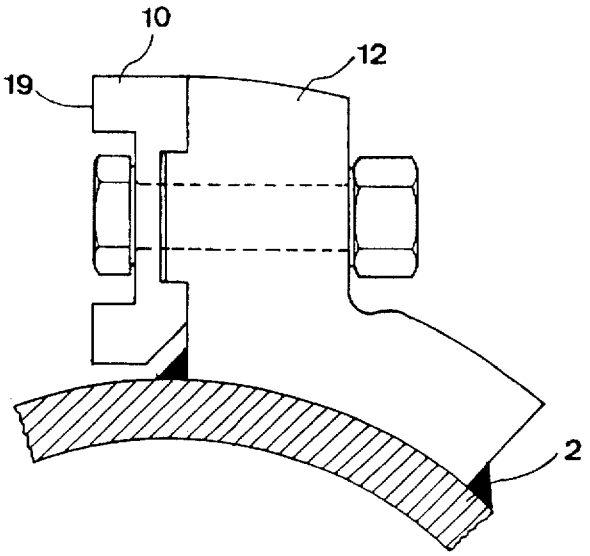
FIG. 8 is a view corresponding to FIG. 6 of a differently designed conveying member.

Another possible embodiment of the conveying member 10 is illustrated in FIG. 8. The conveying member comprises neutral conveying surfaces 19 directed in a substantially tangential direction and having no marked character suitable for material processing.

Figure 9:
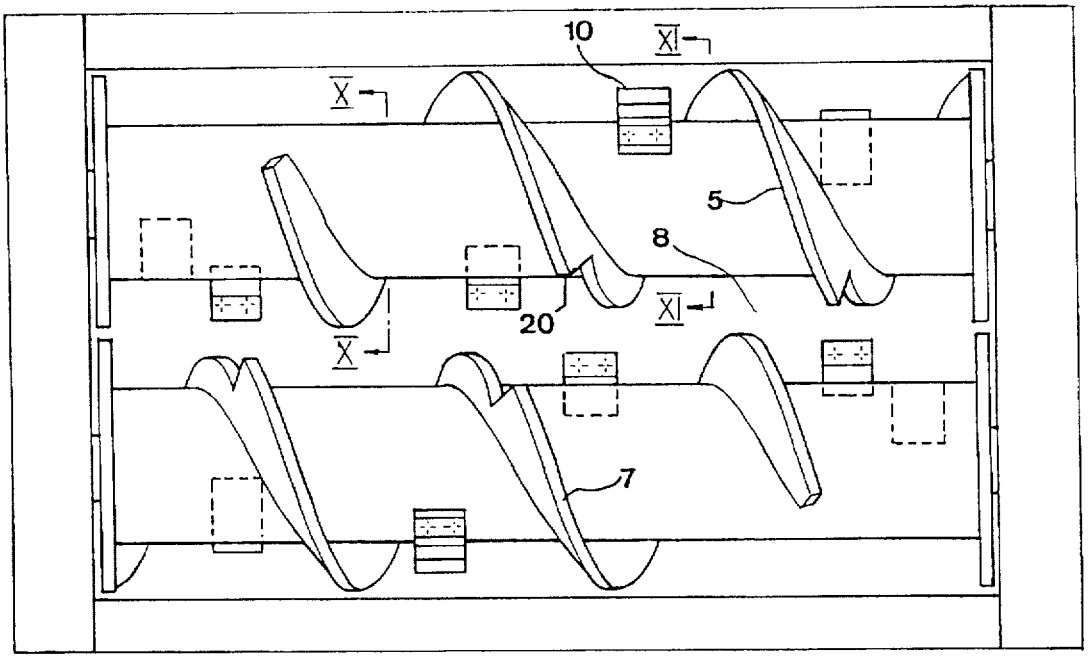
FIG. 9 is a view corresponding to FIG. 1 of a device according to a second preferred embodiment of the invention.
Figure 10:
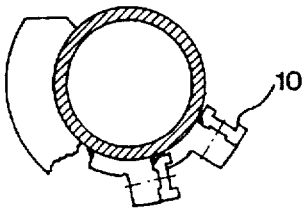
FIGS. 10 and 11 are sectional views along the lines X—X and XI—XI respectively in FIG. 9.
Figure 11:
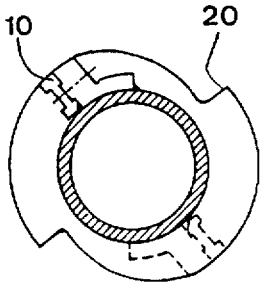

In FIG. 9 a device according to a second preferred embodiment of the invention is illustrated. This embodiment is designed in a similar manner as the one illustrated in FIG. 1 with the following exceptions. The pitch of the thread forming the processing members of the respective axle is here substantially larger than in the device according to FIG. 1, which means that the axial distance between two consecutive processing members becomes comparatively large, for what reason the need for arrangement of recesses in the processing members at the level of the conveying members as seen in the circumferential direction is decreased. Accordingly, the processing members do not present any such recesses, but they are instead provided with additional conveying members in the form of hooks 20 acting in the intended direction of rotation and obtained by means of cut-outs in the conveying members. In this case two such hooks 20 are arranged per thread turn, more specifically substantially opposite to each other. The conveying members 10 are arranged between the respective thread turns and in the end region, which is free from processing members, of the respective axle, the conveying members being arranged to project substantially equally far in a radial direction from the axle in question as the adjacent processing member portions, as viewed in axial direction. This location and design of the conveying members is possible thanks to the large distance between adjacent processing members. The operation of the device according to FIG. 9 is substantially the same as of the device according to FIG. 1, apart from the fact that the conveying members 10 cooperate with the hooks 20 for actuating material transversely to the axles and into the processing zone 8 between the processing members 5, 7.

Figure 12:
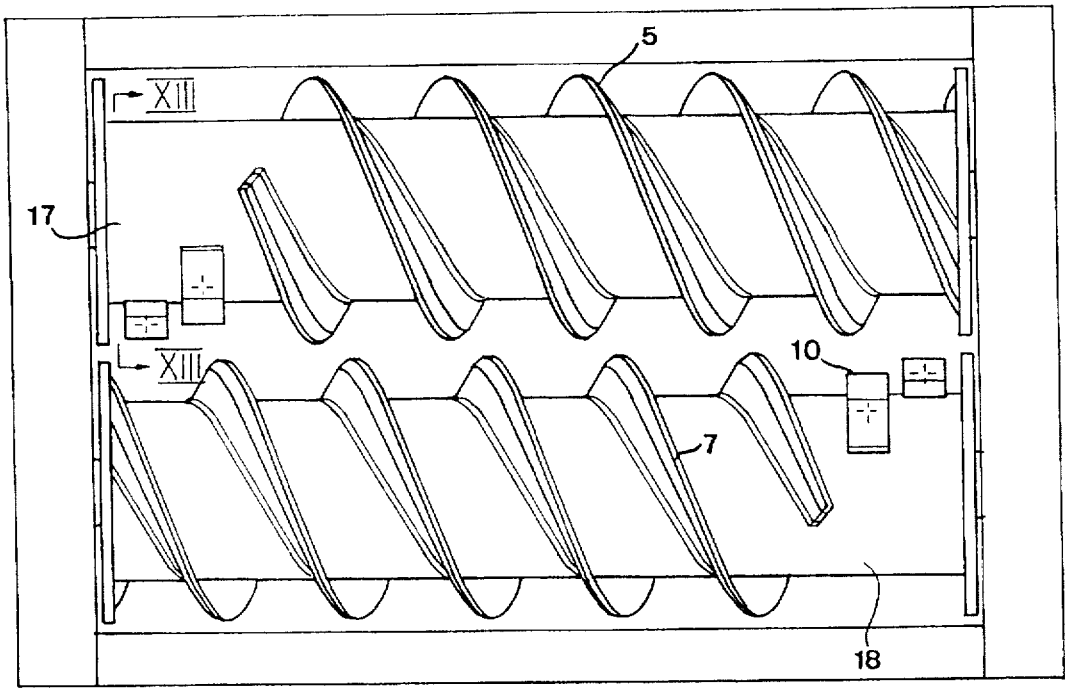
FIG. 12 is a view corresponding to FIG. 1 of a device according to a third preferred embodiment of the invention.
Figure 13:
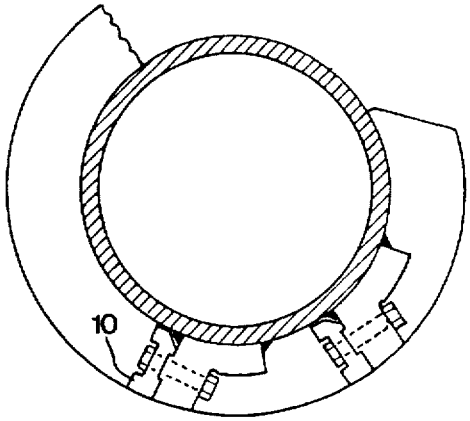
FIG. 13 is a sectional view along the line XIII—XIII in FIG. 12.

The third embodiment of a device according to the invention and shown in FIG. 12 differs from the one shown in FIG. 1 by the processing members not having any recesses and no conveying members being arranged between adjacent processing members. Instead conveying members 10 are arranged in the end region, which is free from processing members and located as far ahead as possible in the feeding direction, of the respective axle so as to "throw over" material to the opposite axle for axial actuation thereof into the processing zone between the first and second processing members 5 and 7 respectively. In this embodiment all material may efficiently be brought to the actual disintegration zone between the first and second processing members and the material actuation thereof in axial direction and, accordingly, their disintegrating action, may be maintained at an optimum level.

Finally, FIG. 14 illustrates how a further third axle 21 with preferably axially acting processing members may be arranged under two other axles 2, 3. Material disintegrated in the processing zone 8 between the two axles 2 and 3 will here fall down towards the third axle 21 and thanks to the direction of rotation chosen for the axles 3 and 21, the material will be actuated towards a counter member 23 arranged in the frame of the device and directed into the interspace 22 between the axles 3 and 21 to be disintegrated additionally against the counter member and then fall down through a lower opening 24 in the frame. This is only a possible but preferable combination of axles.

The invention is of course not only restricted to the preferred embodiments described above but a variety of possibilities for modifications thereof should be obvious for a man skilled in the art without making him deviate from the basic concept of the invention.

It is for instance quite possible to design the processing members in some other way than as thread turn portions of screw threads, for example in the form of inclined plates or discs arranged on the axle, said plates or discs being designed to extend about the axle entirely or partially.

It would also be conceivable to make the device comprise a different number of axles than what has been shown above, it being possible for the device to comprise one single axle and the other processing members could then be arranged on a wall or similar.

The claim definitions regarding the actuation by means of the processing members and the conveying members "in axial direction" and "transversely to the axle" are intended to make clear that said actuation comprises considerable force components in these directions, but that actuation simultaneously also may occur in directions inclined thereto.

Finally, the claim definition "recess" is also intended to include that there is no processing member but an interruption of the processing member actuating the material in axial direction.

I claim:

1. A device for disintegration of material, said device comprising at least one first axle having first processing members adapted to actuate the material, on rotation of the axle, in an axial direction towards second processing members for disintegration of the material, characterized in that the axle in addition is provided with conveying members arranged to actuate and tend to convey the material, on rotation of the axle, transversely relative to the axle and at least one of the first processing members is arranged to extend about the axle whereas it projects from a mantle of the axle, that said processing member along at least a part of its extent presents a recess adapted to decrease the amount of projection of the processing member from the mantle of the axle relative to the rest of the extent of the processing member, that at least one of said conveying members is arranged on the axle in the vicinity of the processing member, which is provided with the recess, within the circumferential extent of the recess, as viewed in the axial direction, said conveying member projecting further outwardly in a radial direction from the axle than the last mentioned processing member within said circumferential extent of the recess.

2. A device according to the claim 1, wherein each of said conveying means is arranged with an interspace to an adjacent first processing member at least in one direction of the axle.

3. A device according to claim 1, wherein at least one of said conveying means is arranged to be free standing from said first processing members in both axial directions.

4. A device according to claim 1, wherein the conveying member is designed to be present inwardly of circles generated, on rotation of the axle, by such portions of the first processing member which are adjacent to the recess.

5. A device according to claim 1 wherein the conveying member is provided with portions, which are located in the region of the rear end of said recess and which are designed for actuating the material in the direction of rotation of the axle.

6. A device according to claim 1, wherein at least two first processing members, which are adjacent as viewed in the axial direction, are provided with at least one recess, these two recesses overlapping each other substantially in a circumferential direction, as viewed in an axial direction, and that said conveying member is arranged on the axle in the area between the two first processing members.

7. A device according to claim 1, wherein the mantle of the axle is free from first processing members at least in the region of one end of the axle, that at least one said conveying member is arranged in this region, and that at least one second processing member is arranged in the vicinity of the axle in the transverse direction thereof opposite to the conveying member and to be hit by material conveyed by the latter.

8. A device according to claim 7, wherein the second processing member arranged oppositely to said end region is designed to actuate material, on rotation of the second axle in a direction intended for material disintegration, in an axial direction towards the opposite end region of the first axle.

9. A device according to claim 8, wherein the mantle of the second axle is free from second processing members in the region of an end located opposite to said end region of the first axle, that at least one member, which is adapted to actuate and tend to convey goods transversely to the second axle on rotation thereof, is arranged on the second axle in its end region, and that the first and second processing members are arranged to co-operate whereas the direction of rotation of the respective axles is chosen to actuate material in an axial direction from the respective said end region and towards the opposite end of the respective axle.

10. A device according to claim 7, wherein the conveying member arranged in said end region is adapted to co-operate in a material disintegrating manner with the second processing member arranged oppositely thereto.

11. A device according to claim 1, further comprising a second rotatable axle, on which the second processing members are arranged, and that the two axles are arranged to be rotated while achieving an actuation of the material by means of the first processing members relative to the second and vice versa in opposite axial directions for disintegration of the material.

12. A device according to claim 11, wherein said second axle is provided with said conveying member.

13. A device according to claim 11, wherein the second axle is a further first axle and that the first processing members arranged thereupon form said second processing members.

14. A device according to claim 11, wherein both axles are arranged beside each other at substantially the same level with a processing zone located therebetween, and that the axles are intended to rotate in opposite directions for disintegrating material so that they both pass the processing zone from above and downwardly.

15. A device according to claim 11 wherein the second processing member arranged oppositely to said end region is designed to actuate material, on rotation of the second axle in a direction intended for material disintegration, in an axial direction towards the opposite end region of the first axle.

16. A device according to claim 1, wherein the first processing members are formed as screw thread elements extending helically around the axle in question, and that adjacent first processing members are formed by axially separated, consecutive thread turn portions.

17. A device according to claim 1, wherein at least one of the conveying members is arranged to, on rotation of the axle on which it is provided, apply forces on the material substantially perpendicularly to the extent of the axle.

18. A device according to claim 1, wherein at least one of said conveying members is removably securable to a holder attached to the axle.

19. A device according to claim 1, wherein the conveying member has the character of a processing member and is adapted to actuate material transversely to the axle by means of portions designed for material processing.

20. A device according to claim 19, wherein said portions designed for material processing comprise a cutting edge.

21. A device according to claim 20, wherein the cutting edge is directed substantially tangentially relative to the axle.

* * * * *